US008802606B2

(12) United States Patent
Rabbat et al.

(10) Patent No.: US 8,802,606 B2
(45) **Date of Patent: *Aug. 12, 2014**

(54) LUBRICANT COMPOSITION HAVING IMPROVED ANTIWEAR PROPERTIES

(75) Inventors: Philippe Marc Andre Rabbat, New York, NY (US); Ryan James Fenton, Norwalk, CT (US); David Eliezer Chasan, Teaneck, NJ (US); Kevin J. DeSantis, Upper Nyack, NY (US); Michael Hoey, Maplewood, NJ (US); Eugene Scanlon, Mamaroneck, NY (US)

(73) Assignee: BASF SE, Ludwigshafen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/182,116

(22) Filed: Jul. 13, 2011

(65) Prior Publication Data

US 2012/0035088 A1 Feb. 9, 2012

Related U.S. Application Data

(63) Continuation-in-part of application No. 12/852,147, filed on Aug. 6, 2010.

(51) Int. Cl.
*C10M 145/04* (2006.01)
*C10M 145/24* (2006.01)

(52) U.S. Cl.
USPC ..... 508/517; 508/100

(58) Field of Classification Search
USPC ..... 508/517
See application file for complete search history.

(56) References Cited

U.S. PATENT DOCUMENTS 2,010,154 A 8/1935 Hubacher
2,653,972 A 9/1953 Ash et al.

(Continued)

FOREIGN PATENT DOCUMENTS

CN 101437931 A 5/2009
DE 2418444 A1 10/1975

(Continued)

OTHER PUBLICATIONS

No English language abstract available for DE 2418444. However, see English language equivalent US 3,992,443. Extracted from the espacenet.com database on Aug. 18, 2011, 23 pages.

(Continued)

*Primary Examiner* — Vishal Vasisth
(74) *Attorney, Agent, or Firm* — Howard & Howard Attorneys PLLC

(57) ABSTRACT

The instant invention provides a lubricant composition having improved four-ball antiwear properties. The lubricant composition includes a base oil and one or more alkylethercarboxylic acid corrosion inhibitor(s) having the formula:

wherein R is a straight or branched chain $C_6$-$C_{18}$ alkyl group and n is a number of from 0 to 5. The lubricant composition also includes an ashless antiwear additive including phosphorous. The four-ball antiwear properties are reported as an average diameter of wear scars pursuant to ASTM D4172. The average diameter of the wear scars resulting from the lubricant composition are at least 5% smaller than the average diameter of the wear scars resulting from a standard that includes the base oil and the antiwear additive and that is free of the one or more alkylethercarboxylic acid corrosion inhibitor(s).

27 Claims, 2 Drawing Sheets

(56) References Cited

U.S. PATENT DOCUMENTS

| | | | |
|---|---|---|---|
| 2,745,857 | A | 5/1956 | Britton et al. |
| 2,801,972 | A | 8/1957 | Bartlett et al. |
| 2,803,646 | A | 8/1957 | Bell et al. |
| 3,625,893 | A | 12/1971 | Brook et al. |
| 3,755,176 | A | 8/1973 | Kinney et al. |
| 3,791,971 | A | 2/1974 | Lowe |
| 3,828,086 | A | 8/1974 | Kenney et al. |
| 3,856,688 | A | 12/1974 | Kenney et al. |
| 3,890,381 | A | 6/1975 | Kiyoura et al. |
| 3,956,382 | A | 5/1976 | Krause |
| 3,992,443 | A | 11/1976 | Springmann |
| 4,088,590 | A | 5/1978 | Knoblauch et al. |
| 4,098,818 | A | 7/1978 | Krummel et al. |
| 4,214,101 | A | 7/1980 | Miya et al. |
| 4,265,774 | A | 5/1981 | Langdon |
| 4,579,672 | A | 4/1986 | Brecker et al. |
| 4,625,057 | A | 11/1986 | Springmann et al. |
| 4,713,487 | A | 12/1987 | Sekine et al. |
| 4,719,052 | A | 1/1988 | Ohsaka et al. |
| 4,784,781 | A | 11/1988 | Denis et al. |
| 4,898,687 | A | 2/1990 | Parker et al. |
| 4,954,273 | A | 9/1990 | Denis et al. |
| 4,976,893 | A | 12/1990 | Leupold |
| 4,978,785 | A | 12/1990 | Sanderson et al. |
| 5,013,482 | A | 5/1991 | O'Neil |
| 5,223,642 | A | 6/1993 | Schonwalder |
| 5,230,823 | A | 7/1993 | Wise et al. |
| 5,233,087 | A | 8/1993 | Cripe |
| 5,250,203 | A | 10/1993 | Denis et al. |
| 5,263,308 | A | 11/1993 | Lee et al. |
| 5,275,809 | A | 1/1994 | Chen et al. |
| 5,282,987 | A | 2/1994 | Balzer et al. |
| 5,292,940 | A | 3/1994 | Carduck et al. |
| 5,296,218 | A | 3/1994 | Chen et al. |
| 5,368,761 | A | 11/1994 | Gore et al. |
| 5,374,366 | A | 12/1994 | Nakahara et al. |
| 5,412,049 | A | 5/1995 | Argyropoulos et al. |
| 5,440,000 | A | 8/1995 | Shirodkar et al. |
| 5,463,114 | A | 10/1995 | Noack et al. |
| 5,490,950 | A | 2/1996 | Smid et al. |
| 5,516,440 | A | 5/1996 | Dasai et al. |
| 5,576,470 | A | 11/1996 | Tuller et al. |
| 5,597,871 | A | 1/1997 | Auschra et al. |
| 5,609,862 | A | 3/1997 | Chen et al. |
| 5,773,505 | A | 6/1998 | Pennewiss et al. |
| 5,843,874 | A | 12/1998 | Macpherson et al. |
| 5,863,999 | A | 1/1999 | Kinker et al. |
| 5,955,405 | A | 9/1999 | Liesen et al. |
| 5,969,068 | A | 10/1999 | Bryant et al. |
| 6,034,040 | A | 3/2000 | Ozbalik et al. |
| 6,063,146 | A | 5/2000 | Miller et al. |
| 6,133,210 | A | 10/2000 | Tipton |
| 6,140,431 | A | 10/2000 | Kinker et al. |
| 6,255,261 | B1 | 7/2001 | Liesen et al. |
| 6,290,869 | B1 | 9/2001 | Sorensen et al. |
| 6,291,409 | B1 | 9/2001 | Kodali et al. |
| 6,294,628 | B1 | 9/2001 | Bryant et al. |
| 6,323,164 | B1 | 11/2001 | Liesen et al. |
| 6,326,514 | B1 | 12/2001 | Klug et al. |
| 6,348,554 | B1 | 2/2002 | Roos et al. |
| 6,391,996 | B1 | 5/2002 | Scherer et al. |
| 6,403,745 | B1 | 6/2002 | Scherer et al. |
| 6,403,746 | B1 | 6/2002 | Roos et al. |
| 6,458,749 | B2 | 10/2002 | Kinker et al. |
| 6,511,946 | B1 | 1/2003 | Theis et al. |
| 6,525,006 | B2 | 2/2003 | Yoneta et al. |
| 6,569,969 | B2 | 5/2003 | Charmot et al. |
| 6,586,375 | B1 | 7/2003 | Gahagan et al. |
| 6,610,801 | B1 | 8/2003 | Scherer |
| 6,610,802 | B2 | 8/2003 | Roos et al. |
| 6,627,584 | B2 | 9/2003 | Ozbalik |
| 6,712,991 | B2 | 3/2004 | Gore et al. |
| 6,780,824 | B2 | 8/2004 | Oelscher et al. |
| 6,787,663 | B2 | 9/2004 | Adams et al. |
| 6,803,050 | B2 | 10/2004 | Denzer et al. |
| 6,881,780 | B2 | 4/2005 | Bryant et al. |
| 7,008,561 | B2 | 3/2006 | Dahlmann et al. |
| 7,189,682 | B2 | 3/2007 | Gapinski |
| 7,208,118 | B2 | 4/2007 | Leinweber et al. |
| 7,214,276 | B2 | 5/2007 | Dahlmann et al. |
| 7,429,555 | B2 | 9/2008 | Scherer |
| 7,470,381 | B2 | 12/2008 | Placek et al. |
| 7,553,673 | B2 | 6/2009 | Kinker et al. |
| 7,560,420 | B2 | 7/2009 | Kinker et al. |
| 7,615,522 | B2 | 11/2009 | Camenzind et al. |
| 7,645,842 | B2 | 1/2010 | Acker et al. |
| 7,648,950 | B2 | 1/2010 | Placek et al. |
| 7,851,420 | B2 | 12/2010 | Theunissen et al. |
| 7,875,581 | B2 | 1/2011 | Chiba et al. |
| 8,343,905 | B2 | 1/2013 | Gutierrez et al. |
| 2003/0194388 | A1 | 10/2003 | Dahlmann et al. |
| 2004/0014611 | A1 | 1/2004 | Li |
| 2004/0014879 | A1 | 1/2004 | Denzer et al. |
| 2004/0235680 | A1 | 11/2004 | Lawrence et al. |
| 2005/0262643 | A1 | 12/2005 | Nogues Lopez et al. |
| 2005/0288191 | A1 | 12/2005 | Lawrence et al. |
| 2007/0184202 | A1 | 8/2007 | Rochfort et al. |
| 2007/0197407 | A1 | 8/2007 | Bardasz et al. |
| 2008/0076687 | A1 | 3/2008 | Habeeb et al. |
| 2009/0017243 | A1* | 1/2009 | Hei et al. ..... 428/35.7 |
| 2010/0009879 | A1 | 1/2010 | Theyssen et al. |
| 2010/0081716 | A1 | 4/2010 | Matsunaga et al. |
| 2010/0130392 | A1 | 5/2010 | Theyssen et al. |
| 2010/0286009 | A1 | 11/2010 | Vierbaum et al. |
| 2011/0034359 | A1 | 2/2011 | Rabbat et al. |

FOREIGN PATENT DOCUMENTS

| | | | |
|---|---|---|---|
| DE | 4244536 | A1 | 7/1994 |
| DE | 19730085 | A1 | 1/1999 |
| DE | 19747895 | A1 | 5/1999 |
| DE | 19833894 | A1 | 2/2000 |
| DE | 19956237 | A1 | 5/2001 |
| EP | 0399751 | A2 | 11/1990 |
| EP | 0566956 | A1 | 10/1993 |
| EP | 1652909 | A1 | 5/2006 |
| EP | 2042587 | A1 | 4/2009 |
| EP | 2050806 | A1 | 4/2009 |
| JP | 2097592 | A | 4/1990 |
| JP | 2097593 | A | 4/1990 |
| JP | 08333592 | | 12/1996 |
| JP | 09040982 | | 2/1997 |
| JP | 09040990 | | 2/1997 |
| JP | 11199881 | | 7/1999 |
| JP | 2001335696 | | 12/2001 |
| JP | 2002212007 | | 7/2002 |
| JP | 2002275483 | | 9/2002 |
| JP | 2005247850 | A | 9/2005 |
| JP | 2008031149 | | 2/2008 |
| JP | 2008106253 | | 5/2008 |
| JP | 2009096997 | | 5/2009 |
| JP | 2009-197338 | | 9/2009 |
| JP | 2009197338 | | 9/2009 |
| PL | 314357 | | 11/1996 |
| PL | 182003 | B1 | 10/2001 |
| WO | WO 9856881 | A1 | 12/1998 |
| WO | WO 2004037960 | A1 | 5/2004 |
| WO | WO 2008073951 | A1 | 6/2008 |
| ZA | 9809884 | | 4/1999 |

OTHER PUBLICATIONS

English language abstract for DE 4244536 extracted from the espacenet.com database on Aug. 17, 2011, 7 pages.

English language abstract for DE 19730085 extracted from the espacenet.com database on Aug. 18, 2011, 5 pages.

English language abstract for DE 19747895 extracted from the espacenet.com database on Aug. 17, 2011, 27 pages.

English language abstract for DE 19833894 extracted from the espacenet.com database on Aug. 8, 2011, 7 pages.

English language abstract for DE 19956237 extracted from the espacenet.com database on Aug. 17, 2011, 9 pages.

English language abstract for EP 0566956 extracted from the espacenet.com database on Aug. 17, 2011, 9 pages.

(56) References Cited

OTHER PUBLICATIONS

English language abstract for EP 2050806 extracted from the espacenet.com database on Aug. 17, 2011, 11 pages.
English language abstract for JP 2097592 extracted from the espacenet.com database on Aug. 17, 2011, 7 pages.
English language abstract for JP 2097593 extracted from the espacenet.com database on Aug. 17, 2011, 7 pages.
English language abstract and translation for JP 08333592 extracted from the PAJ database on Aug. 17, 2011, 18 pages.
English language abstract and translation for JP 09040982 extracted from the PAJ database on Aug. 17, 2011, 25 pages.
English language abstract and translation for JP 09040990 extracted from the PAJ database on Aug. 17, 2011, 25 pages.
English language abstract and translation for 11199881 extracted from the PAJ database on Aug. 17, 2011, 33 pages.
English language abstract and translation for JP 2001335696 extracted from the PAJ database on Aug. 17, 2011, 23 pages.
English language abstract and translation for JP 2002212007 extracted from the PAJ database on Aug. 17, 2011, 26 pages.
English language abstract and translation for JP 2002275483 extracted from the PAJ database on Aug. 17, 2011, 27 pages.
English language abstract and translation for JP 2008106253 extracted from the PAJ database on Aug. 17, 2011, 49 pages.
English language abstract and translation for JP 2008031149 extracted from the PAJ database on Aug. 17, 2011, 150 pages.
English language abstract and translation for JP 2009096997 extracted from the PAJ database on Aug. 17, 2011, 138 pages.
English language abstract and translation for JP 2009197338 extracted from the PAJ database on Aug. 17, 2011, 56 pages.
English language abstract for PL 314357. Original document not available. However, see foreign language equivalent PL 182003, 10 pages.
Klaus Noweck et al., "Fatty Alcohols," Ullmanns's Encyclopedia of Industrial Chemistry, 2006, 26 pages.
Clark et al., "New Generation of Ashless Top Tier Hydraulic Fluids," Lubrication Engineering, Apr. 2000, 10 pages.
Falbe et al., "Alcohols, Aliphatic," Ullmann's Encyclopedia of Industrial Chemistry, 2005; Wiley-VCH Verlag GmbH & Co., 27 pages.
D. Clark et al., "New Generation of Ashless Top Tier Hydraulic Fluids/North America," not dated, printed off www.allbusiness.com on Jan. 14, 2011, 10 pages.
Butke et al., "Contamination of Power Generation Lubricants," Journal of ASTM International, vol. 4, No. 10, Nov. 2007, 7 pages.
Appendix E—"API Base Oil Interchangeability Guidelines for Passenger Car Motor Oils and Diesel Engine Oils," API 1509, Engine Oil Licensing and Certification System, 16th Edition, Jul. 2009, 26 pages.
Zhao et al., "Oxidation of Primary Alcohols to Carboxylic Acids with Sodium Chlorite Catalyzed by Tempo and Bleach: 4-Methoxyphenylacetic Acid," Organic Synthesis, 2005, vol. 81, p. 195-203.
International Search Report for Application No. PCT/US2010/044747 dated Nov. 29, 2010, 3 pages.
English language abstract and translation for DE 19956237 extracted from the espacenet.com database, 16 pages.
English language abstract and translation for JP 2009-197338 extracted from the PAJ database, 43 pages.
English language abstract for EP 1652909 extracted from the espacenet.com database on Jul. 31, 2012, 14 pages.
International Search Report for Application No. PCT/US2012/036327 dated Jul. 11, 2012, 3 pages.
English language abstract for CN 101437931 extracted from the espacenet.com database on Jul. 24, 2013, 18 pages.
English Language abstract for JP2005247850 extracted from espacenet.com database on Apr. 14, 2014, 12 pages.

* cited by examiner

LUBRICANT COMPOSITION HAVING IMPROVED ANTIWEAR PROPERTIES

RELATED APPLICATIONS

This application is a continuation-in-part of U.S. application Ser. No. 12/852,147, filed on Aug. 6, 2010, the disclosure of which is expressly incorporated herein by reference in its entirety.

FIELD OF THE INVENTION

The present invention generally relates to a lubricant composition including a base oil, one or more alkylethercarboxylic acid corrosion inhibitor(s), and an ashless antiwear additive including phosphorous. More specifically, the lubricant composition has improved antiwear properties as compared to a standard that includes the base oil and the antiwear additive and that is free of the one or more alkylethercarboxylic acid corrosion inhibitor(s).

DESCRIPTION OF THE RELATED ART

Lubricant compositions are generally well known in the art and are broadly categorized as oil or water based compositions, i.e., compositions that include large weight percentages of non-polar compounds (such as (base) oils) or large weight percentages of water, respectively. Lubricant compositions are typically further categorized as engine oils, driveline system oils, gear oils, greases, automatic and manual transmission fluids and oils, hydraulic oils, industrial gear oils, turbine oils, rust and oxidation (R&O) inhibited oils, compressor oils, or paper machine oils, etc. Each of these compositions has particular specifications and design requirements and most are designed to minimize corrosion and wear, to resist thermal and physical breakdown, and to be able to minimize the effects of common contaminants such as oxidizing compounds and metal fragments.

Additives such as corrosion inhibitors and antiwear additives can be utilized to improve corrosion and wear resistance of the composition, respectively. However, it is well known in the art that corrosion inhibitors acts antagonistically to antiwear additives to reduce the effectiveness of antiwear additives. For this reason, trade-offs are made when formulating compositions to balance corrosion and wear resistance. Accordingly, there remains an opportunity to develop an improved lubricant composition.

SUMMARY OF THE INVENTION AND ADVANTAGES

The instant invention provides a lubricant composition having improved four-ball antiwear properties. The lubricant composition includes a base oil and one or more alkylethercarboxylic acid corrosion inhibitor(s) having the formula:

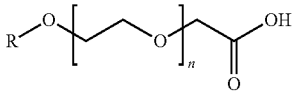

wherein R is a straight or branched chain $C_6$-$C_{18}$ alkyl group and n is a number of from 0 to 5. The lubricant composition also includes an ashless antiwear additive including phosphorous. The four-ball antiwear properties are reported as an average diameter of wear scars pursuant to ASTM D4172.

The average diameter of the wear scars resulting from the lubricant composition are at least 5% smaller than the average diameter of the wear scars resulting from a standard that includes the base oil and the antiwear additive and that is free of the one or more alkylethercarboxylic acid corrosion inhibitor(s). The invention also provides a method that includes the step of applying the lubricant composition to a metal to reduce wear of the metal.

The one or more alkylethercarboxylic acid corrosion inhibitor(s) unexpectedly enhances the effect of the antiwear additives relative to the four-ball antiwear properties. At the same time, the corrosion inhibitor allows the composition to have excellent corrosion resistance properties when applied to the metal. This combination of excellent antiwear and corrosion resistance properties unexpectedly contradicts traditional wisdom.

BRIEF DESCRIPTION OF THE SEVERAL VIEWS OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
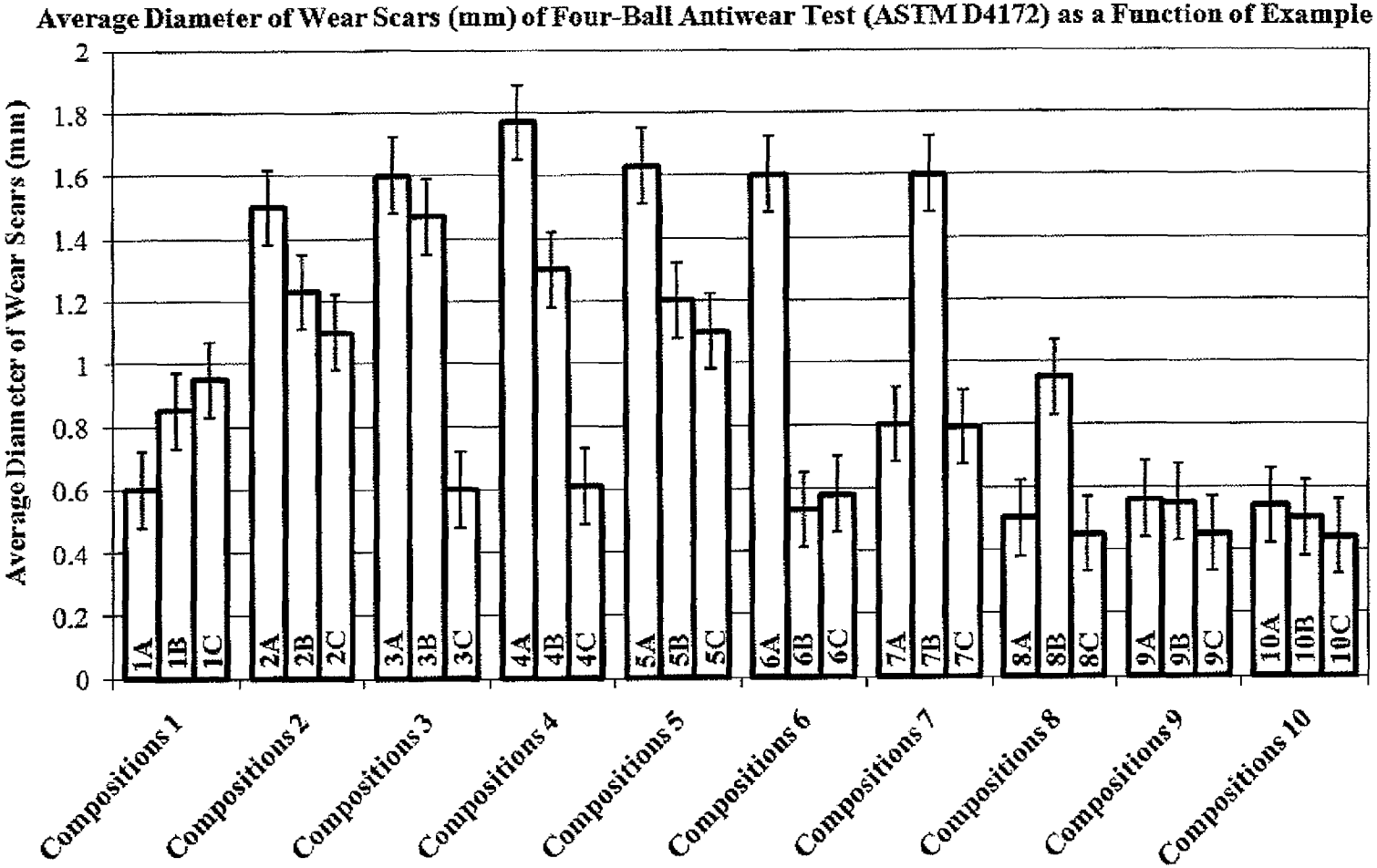
FIG. 1 is a bar graph that shows the average wear scars (mm) measured in a Four-Ball Antiwear Test (ASTM D4172) as a function of Examples 1(A-C)-10(A-C)

The present invention provides a lubricant composition. The lubricant composition may be further defined as ash-containing or ash-less, according to ASTM D 874 and known in the art. Typically, the terminology "ash-less" refers to the absence of (significant) amounts of metals such as sodium, potassium, calcium, and the like. Of course, it is to be understood that the lubricant composition is not particularly limited to being defined as either ash-containing or ash-less.

In various embodiments, the lubricant composition can be further described as a fully formulated lubricant or alternatively as an engine oil. In one embodiment, the terminology "fully formulated lubricant" refers to a total final composition that is a final commercial oil. This final commercial oil may include, for instance, detergents, dispersants, antioxidants, antifoam additives, pour point depressants, viscosity index improvers, anti-wear additives, friction modifiers, and other customary additives. In the art, engine oils may be referred to as including a base oil as described below and performance additives. The lubricant composition may be as described in U.S. Ser. No. 61/232,060, filed on Aug. 7, 2009, the disclosure of which is expressly incorporated herein by reference in its entirety.

The lubricant composition (hereinafter referred to as "composition") includes a base oil, one or more alkylethercarboxylic acid corrosion inhibitor(s), and an ashless antiwear additive including phosphorous, each of which are described in greater detail below. In various embodiments, the composition may consist essentially of the base oil, the one or more alkylethercarboxylic acid corrosion inhibitor(s), and the ashless antiwear additive including phosphorous. In such an embodiment, the composition is typically free of (or includes less than 10 wt %, 5 wt %, 1 wt %, 0.5 wt %, or 0.1 wt %) ashed antiwear additives, additional corrosion inhibitors, etc. Alternatively, the composition may consist of the base oil, the one or more alkylethercarboxylic acid corrosion inhibitor(s), and the ashless antiwear additive including phosphorous.

Base Oil:

The base oil is not particularly limited and may be further defined as including one or more oils of lubricating viscosity such as natural and synthetic lubricating or base oils and mixtures thereof. In one embodiment, the base oil is further defined as a lubricant. In another embodiment, the base oil is further defined as an oil of lubricating viscosity. In still another embodiment, the base oil is further defined as a crankcase lubricating oil for spark-ignited and compression ignited internal combustion engines, including automobile and truck engines, two-cycle engines, aviation piston engines, and marine and railroad diesel engines. Alternatively, the base oil can be further defined as an oil to be used in gas engines, stationary power engines, and turbines. The base oil may be further defined as a heavy or light duty engine oil. In one embodiment, the base oil is further defined as a heavy duty diesel engine oil. Alternatively, the base oil may be described as an oil of lubricating viscosity or lubricating oil, for instance as disclosed in U.S. Pat. No. 6,787,663 and U.S. 2007/0197407, each of which is expressly incorporated herein by reference. Alternatively, the base oil may be used in or as an engine oil, driveline system oil, gear oil, grease, automatic and manual transmission fluid or oil, hydraulic oil, industrial gear oil, turbine oil, rust and oxidation (R&O) inhibited oil, compressor oil, or paper machine oil, etc. It is also contemplated that the base oil may be as described in U.S. Ser. No. 61/232,060, filed on Aug. 7, 2009, the disclosure of which is expressly incorporated herein by reference in its entirety.

The base oil may be further defined as a base stock oil. Alternatively, the base oil may be further defined as a component that is produced by a single manufacturer to the same specifications (independent of feed source or manufacturer's location) that meets the same manufacturer's specification and that is identified by a unique formula, product identification number, or both. The base oil may be manufactured or derived using a variety of different processes including but not limited to distillation, solvent refining, hydrogen processing, oligomerization, esterification, and re-refining. Re-refined stock is typically substantially free from materials introduced through manufacturing, contamination, or previous use. In one embodiment, the base oil is further defined as a base stock slate, as is known in the art.

Alternatively, the base oil may be derived from hydrocracking, hydrogenation, hydrofinishing, refined and re-refined oils or mixtures thereof or may include one or more such oils. In one embodiment, the base oil is further defined as an oil of lubricating viscosity such as a natural or synthetic oil and/or combinations thereof. Natural oils include, but are not limited to, animal oils and vegetable oils (e.g., castor oil, lard oil) as well as liquid petroleum oils and solvent-treated or acid-treated mineral lubricating oils such as paraffinic, naphthenic or mixed paraffinic-naphthenic oils.

In various other embodiments, the base oil may be further defined as an oil derived from coal or shale. Non-limiting examples of suitable oils include hydrocarbon oils such as polymerized and interpolymerized olefins (e.g., polybutylenes, polypropylenes, propylene-isobutylene copolymers, poly(1-hexenes), poly(1-octenes), poly(1-decenes), and mixtures thereof; alkylbenzenes (e.g., dodecylbenzenes, tetradecylbenzenes, dinonylbenzenes, and di(2-ethylhexyl)-benzenes); polyphenyls (e.g., biphenyls, terphenyls, and alkylated polyphenyls), alkylated diphenyl ethers and alkylated diphenyl sulfides and the derivatives, analogs, and homologs thereof.

In still other embodiments, the base oil may be further defined as a synthetic oil which may include one or more alkylene oxide polymers and interpolymers and derivatives thereof wherein terminal hydroxyl groups are modified by esterification, etherification, or similar reactions. Typically, these synthetic oils are prepared through polymerization of ethylene oxide or propylene oxide to form polyoxyalkylene polymers which can be further reacted to form the oils. For example, alkyl and aryl ethers of these polyoxyalkylene polymers (e.g., methylpolyisopropylene glycol ether having an average molecular weight of 1,000; diphenyl ether of polyethylene glycol having a molecular weight of 500-1,000; and diethyl ether of polypropylene glycol having a molecular weight of 1,000-1,500) and/or mono- and polycarboxylic esters thereof (e.g. acetic acid esters, mixed $C_3$-$C_8$ fatty acid esters, or the C13 oxo acid diester of tetraethylene glycol) may also be utilized.

In even further embodiments, the base oil may include esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, and alkenyl malonic acids) with a variety of alcohols (e.g., butyl alcohol, hexyl alcohol, dodecyl alcohol, 2-ethylhexyl alcohol, ethylene glycol, diethylene glycol monoether, and propylene glycol). Specific examples of these esters include, but are not limited to, dibutyl adipate, di(2-ethylhexyl sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and combinations thereof. Esters useful as the base oil or as included in the base oil also include those formed from $C_5$ to $C_{12}$ monocarboxylic acids and polyols and polyol ethers such as neopentyl glycol, trimethylolpropane, pentaerythritol, dipentaerythritol, and tripentaerythritol.

The base oil may be alternatively described as a refined and/or re-refined oil, or combinations thereof. Unrefined oils are typically obtained from a natural or synthetic source without further purification treatment. For example, a shale oil obtained directly from retorting operations, a petroleum oil obtained directly from distillation, or an ester oil obtained directly from an esterification process and used without further treatment, could all be utilized in this invention. Refined oils are similar to the unrefined oils except that they typically have undergone purification to improve one or more properties. Many such purification techniques are known to those of skill in the art such as solvent extraction, acid or base extraction, filtration, percolation, and similar purification techniques. Re-refined oils are also known as reclaimed or reprocessed oils and often are additionally processed by techniques directed to removal of spent additives and oil breakdown products.

The base oil may alternatively be described as specified in the American Petroleum Institute (API) Base Oil Interchangeability Guidelines. In other words, the base oil may be further described as one or a combination of more than one of five base oil groups: Group I (sulfur content >0.03 wt %, and/or <90 wt % saturates, viscosity index 80-120); Group II (sulfur content less than or equal to 0.03 wt %, and greater than or equal to 90 wt % saturates, viscosity index 80-120); Group III (sulfur content less than or equal to 0.03 wt %, and greater than or equal to 90 wt % saturates, viscosity index greater than or equal to 120); Group IV (all polyalphaolefins (PAO's)); and Group V (all others not included in Groups I, II, III, or IV). In one embodiment, the base oil is selected from the group consisting of API Group I, II, III, IV, V and combinations thereof. In another embodiment, the base oil is selected from the group consisting of API Group II, III, IV, and combinations thereof. In still another embodiment, the base oil is further defined as an API Group II, III, or IV oil and includes a maximum of about 49.9 wt %, typically up to a maximum of about 40 wt %, more typically up to a maximum of about 30 wt %, even more typically up to a maximum of about 20 wt %, even more typically up to a maximum of about 10 wt % and even more typically up to a maximum of about 5 wt % of the lubricating oil an API Group I or V oil. It is also contemplated that Group II and Group II basestocks prepared by hydrotreatment, hydrofinishing, hydroisomerzation or other hydrogenative upgrading processes may be included in the API Group II described above. Moreover, the base oil may include Fisher Tropsch or gas to liquid GTL oils. These are disclosed for example in U.S. 2008/0076687, which is expressly incorporated herein by reference.

The base oil is typically present in the composition in an amount of from 70 to 99.9, from 80 to 99.9, from 90 to 99.9, from 75 to 95, from 80 to 90, or from 85 to 95, parts by weight per 100 parts by weight of the composition. Alternatively, the base oil may be present in amounts of greater than 70, 75, 80, 85, 90, 91, 92, 93, 94, 95, 96, 97, 98, or 99, parts by weight per 100 parts by weight of the composition. In various embodiments, the amount of lubricating oil in a fully formulated lubricant (including diluent or carrier oils presents) is from about 80 to about 99.5 percent by weight, for example, from about 85 to about 96 percent by weight, for instance from about 90 to about 95 percent by weight. Of course, the weight percent of the base oil may be any value or range of values, both whole and fractional, within those ranges and values described above and/or may vary from the values and/or range of values above by ±5%, ±10%, ±15%, ±20%, ±25%, ±30%, etc.

One or More Alkylethercarboxylic Acid Corrosion Inhibitor(s):

The one or more alkylethercarboxylic acid corrosion inhibitor(s) each has the formula;

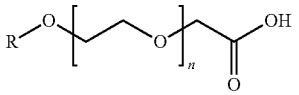

wherein R is a straight or branched chain $C_6$-$C_{18}$ alkyl group and n is a number of from 0 to 5. The alkyl group may be branched or unbranched and may be further defined as, for example, 2-ethylbutyl, n-pentyl, isopentyl, 1-methylpentyl, 1,3-dimethylbutyl, n-hexyl, 1-methylhexyl, n-heptyl, isoheptyl, 1,1,3,3-tetramethylbutyl, 1-methylheptyl, 3-methylheptyl, n-octyl, 2-ethylhexyl, 1,1,3-trimethylhexyl, 1,1,3,3-tetramethylpentyl, nonyl, decyl, undecyl, 1-methylundecyl, dodecyl, 1,1,3,3,5,5-hexamethylhexyl, tridecyl, tetradecyl, pentadecyl, hexadecyl, heptadecyl or octadecyl. In various embodiments, n is a number from 1 to 5, from 2 to 5, from 3 to 5, from 4 to 5, from 2 to 4, from 3 to 4, from 1 to 4, from 1 to 3, or from 1 to 2. In one embodiment, R is a mixture of $C_{12}/C_{14}$ alkyl groups and n is 2.5. Alternatively, n can be further defined as having an "average" value from 1 to 5, from 2 to 5, from 3 to 5, from 4 to 5, from 2 to 4, from 3 to 4, from 1 to 4, from 1 to 3, or from 1 to 2. In these embodiments, the terminology "average value" typically refers to the mean value of n when a mixture of compounds is included. It is contemplated that, upon synthesis, a distribution of compounds may be formed such that n may be an average value. In one embodiment, a distribution of compounds includes a weight percentage majority of compounds wherein n is 3, 4, or 5 and a minority weight percentage of compounds wherein n is 0, 1, or 2. Of course, n may be any value or range of values, both whole and fractional and both actual or average (mean), within those ranges and values described above and/or may vary from the values and/or range of values above by ±5%, ±10%, ±15%, ±20%, ±25%, ±30%, etc.

In one embodiment, R is a mixture of $C_{16}/C_{18}$ alkyl groups and n is 2. In still another embodiment, R is a straight or branched chain $C_{12}$-$C_{14}$ alkyl group and n is about 3. Alternatively, R can include blends of alkyl groups that have even numbers of carbon atoms or odd numbers of carbon atoms, or both. For example, R can include mixtures of $C_x/C_y$ alkyl groups wherein x and y are odd numbers or even numbers. Alternatively, one may be an odd number and the other may be an even number. Typically, x and y are numbers that differ from each other by two, e.g. 6 and 8, 8 and 10, 10 and 12, 12 and 14, 14 and 16, 16 and 18, 7 and 9, 9 and 11, 11 and 13, 13 and 15, or 15 and 17. R can also include mixtures of 3 or more alkyl groups, each of which may include even or odd numbers of carbon atoms. For example, R may include a mixture of $C_9$, $C_{10}$, $C_{11}$, $C_{12}$, $C_{13}$, $C_{14}$, and/or $C_{15}$ alkyl groups. Typically, if R is a mixture of alkyl groups then at least two alkylethercarboxylic acid corrosion inhibitor(s) are present. In other words, no single alkylethercarboxylic acid has two different alkyl groups represented by the same variable R. Thus, the terminology "mixture of alkyl groups" typically refers to a mixture of alkylethercarboxylic acid corrosion inhibitor(s) wherein one type of molecule has a particular alkyl group and a second or additional compounds have other types of alkyl groups.

Accordingly, it is to be understood that the terminology "one or more alkylethercarboxylic acid corrosion inhibitor(s)" may describe a single compound or a mixture of compounds, each of which are alkylethercarboxylic acid corrosion inhibitor(s) of the above described formula. The one or more alkylethercarboxylic acid corrosion inhibitor(s) act as corrosion inhibitors but are not limited to this function. Said differently, one or more alkylethercarboxylic acid corrosion inhibitor(s) may also have additional uses or functions in the composition.

Some alkylethercarboxylic acid corrosion inhibitor(s) are commercially available, for instance AKYPO RLM 25 and AKYPO RO 20 VG, from Kao Specialties Americas LLC. The alkylethercarboxylic acid corrosion inhibitor(s) may also be prepared from alcohol ethoxylates via oxidation, for instance as taught in U.S. Pat. No. 4,214,101, expressly incorporated herein by reference. The alkylethercarboxylic acid corrosion inhibitor(s) may also be prepared by carboxylmethylation of detergent alcohols as disclosed in U.S. Pat. No. 5,233,087 or 3,992,443, each of which is also expressly incorporated herein by reference. It is also contemplated that the one or more alkylethercarboxylic acid corrosion inhibitor(s) may be as described in U.S. Ser. No. 61/232,060, filed on Aug. 7, 2009, the disclosure of which is expressly incorporated herein by reference in its entirety.

The one or more alkylethercarboxylic acid corrosion inhibitor(s) are typically present in the composition in amounts of from about 0.01 to about 0.07 parts by weight per 100 parts by weight of the composition. In various embodiments, the one or more alkylethercarboxylic acid corrosion inhibitor(s) are present in amounts of about 0.01, 0.02, 0.03, 0.04, 0.05, 0.06, or 0.07, parts by weight per 100 parts by weight of the composition. In other embodiments, the one or more alkylethercarboxylic acid corrosion inhibitor(s) are present in amounts of from about 0.01 to 0.07, 0.02 to 0.06, 0.03 to 0.05, or 0.04 to 0.05, parts by weight per 100 parts by weight of the composition. In still other embodiments, the one or more alkylethercarboxylic acid corrosion inhibitor(s) may be present in amount of from 0.1 to 1 parts by weight per 100 parts by weight of the composition. In various embodiments, the one or more alkylethercarboxylic acid corrosion inhibitor(s) may be present in amounts of from 0.01 to 0.2, from 0.05 to 0.2, from 0.1 to 0.2, from 0.15 to 0.2, from 0.01 to 0.05, from 0.1 to 0.5, parts by weight per 100 parts by weight of the composition. Additional non-limiting examples of various suitable parts by weight include 0.1, 0.2, 0.3, 0.4, 0.5, 0.6, 0.7, 0.8, 0.9, and 1.0. In still other embodiments, the one or more alkylethercarboxylic acid corrosion inhibitor(s) may be present in amounts of from 0.03 to 0.07, 0.03 to 0.15, 0.03 to 0.5, 0.07 to 0.15, 0.07 to 0.5, or from 0.15 to 0.5, parts by weight per 100 parts by weight of the composition. Of course, the weight percent of the one or more alkylethercarboxylic acid corrosion inhibitor(s) may be any value or range of values, both whole and fractional, within those ranges and values described above and/or may be present in amounts that vary from the values and/or range of values above by ±5%, ±10%, ±15%, ±20%, ±25%, ±30%, etc.

Antiwear Additive:

The composition also includes the antiwear additive that includes phosphorous, as first introduced above. In one embodiment, the antiwear additive is further defined as a phosphate. In another embodiment, the antiwear additive is further defined as a phosphite. In still another embodiment, the antiwear additive is further defined as a phosphorothionate. The antiwear additive may alternatively be further defined as a phosphorodithioate. In one embodiment, the antiwear additive is further defined as a dithiophosphate. The antiwear additive may also include an amine such as a secondary or tertiary amine. In one embodiment, the antiwear additive includes an alkyl and/or dialkyl amine. Structures of suitable non-limiting examples of antiwear additives are set forth immediately below:

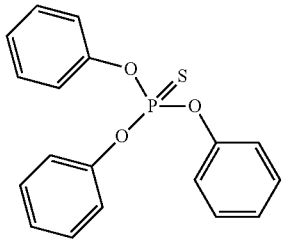

Triphenyl Phosphorothionate

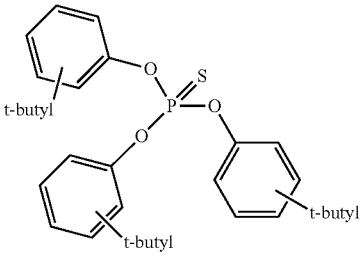

Butylated Triphenyl Phosphorothionate

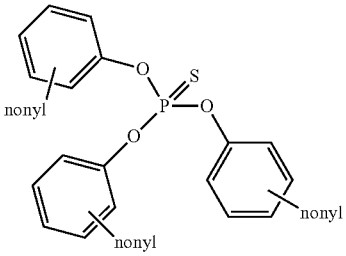

Nonyl Triphenyl Phosphorothionate

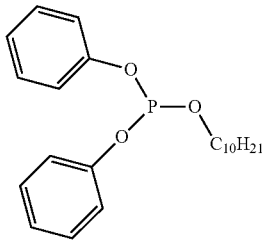

Decyl Diphenylphosphite

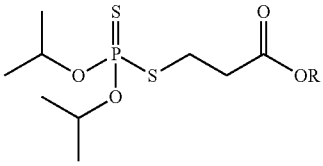

Neutral Dialkyl Dithiophosphate

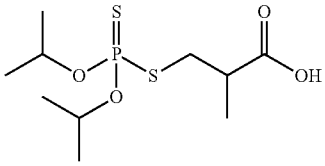

Acidic Dialkyl Dithiophosphate

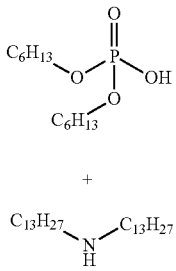

Amine Phosphate + Ditridecyl Amine

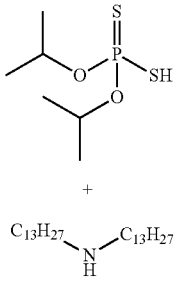

Isopropyl Phosphorodithioate + Ditridecyl Amine

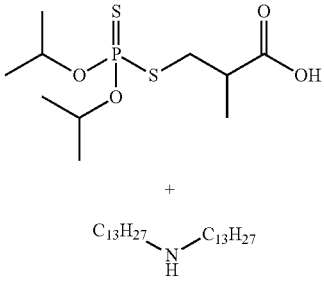

Acidic Dialkyl Dithiophosphate + Ditridecyl Amine

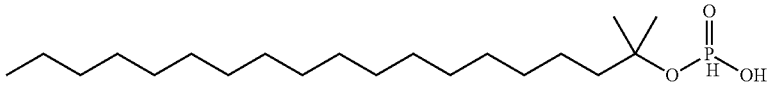

Dimethyloctadecyl Phosphonate

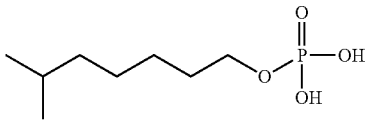

Iso-Octyl Phosphate + $C_{12}$-$C_{14}$ Amine

-continued

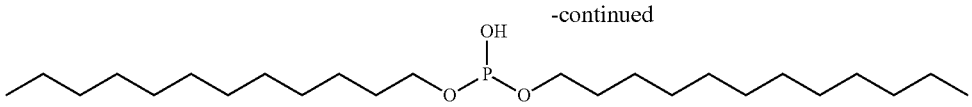

Dilauryl Hydrogen Phosphite

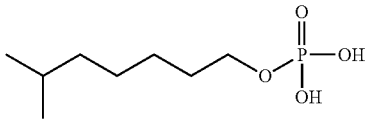

Iso-Octyl Phosphate + $C_{12}$-$C_{14}$ Amine

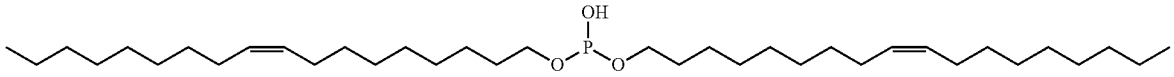

Dioleyl Hydrogen Phosphite

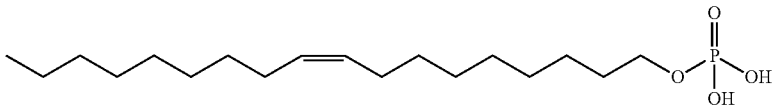

Oleyl Phosphate

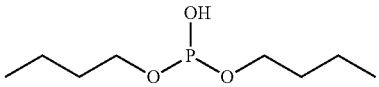

Dibutyl Hydrogen Phosphite wherein R is an alkyl group having from 1 to 10 carbon atoms.

The antiwear additive is typically present in the composition in an amount of from 0.01 to 20, from 0.5 to 15, from 1 to 10, from 5 to 10, from 5 to 15, from 5 to 20, from 0.1 to 1, from 0.1 to 0.5, or from 0.1 to 1.5, parts by weight per 100 parts by weight of the composition. Alternatively, the anti-wear additive may be present in amounts of less than 20, less than 15, less than 10, less than 5, less than 1, less than 0.5, or less than 0.1, parts by weight per 100 parts by weight of the composition. It is also contemplated that the antiwear additive may be present in an amount of from 0.2 to 0.8, from 0.2 to 0.6, from 0.2 to 0.4, or from 0.3 to 0.5, parts by weight per 100 parts by weight of the composition.

In addition to the antiwear additive described above, the composition may also include an additional antiwear additive selected from the group of ZDDP, zinc dialkyl-dithio phosphates, sulfur- and/or phosphorus- and/or halogen-containing compounds, e.g. sulfurised olefins and vegetable oils, zinc dialkyldithiophosphates, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, bis(2-ethylhexyl)aminomethyltolyltriazole, derivatives of 2,5-dimercapto-1,3,4-thiadiazole, ethyl 3-[(diisopropoxyphosphinothioyl)thio] propionate, triphenyl thiophosphate (triphenylphosphorothioate), tris(alkylphenyl) phosphorothioate and mixtures thereof (for example tris(isononylphenyl) phosphorothioate), diphenyl monononylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris[isooctyl 2-acetate], derivatives of 2-mercaptobenzothiazole such as 1-[N,N-bis(2-ethylhexyl)aminomethyl]-2-mercapto-1H-1,3-benzothiazole, ethoxycarbonyl-5-octyldithio carbamate, and/or combinations thereof.

Additives:

In addition to the antiwear additive(s) described above, the composition can additionally include one or more additional additives to improve various chemical and/or physical properties. Non-limiting examples of the one or more additives include antioxidants, metal passivators, viscosity index improvers, pour point depressors, dispersants, detergents, and antifriction additives. One or more of the additional additives may be ash-containing or ash-less as first introduced and described above. Such composition is commonly referred to as an engine oil or as an industrial oil, such as a hydraulic fluid, a turbine oil, an R&O (rust and oxidation inhibited) oil or a compressor oil.

Antioxidants:

Suitable, non-limiting, antioxidants include alkylated monophenols, for example 2,6-di-tert-butyl-4-methylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, 2,6-di-nonyl-4-methylphenol, 2,4-dimethyl-6(1'-methylundec-1'-yl)phenol, 2,4-dimethyl-6-(1'-methylheptadec-1'-yl)phenol, 2,4-dimethyl-6-(1'-methyltridec-1'-yl)phenol, and combinations thereof.

Other non-limiting examples of suitable antioxidants includes alkylthiomethylphenols, for example 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol, and combinations thereof. Hydroquinones and alkylated hydroquinones, for example 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis-(3,5-di-tert-butyl-4-hydroxyphenyl) adipate, and combinations thereof, may also be utilized.

Furthermore, hydroxylated thiodiphenyl ethers, for example 2, 2'-thiobis(6-tert-butyl-4-methylphenol), 2,2'-thiobis(4-octylphenol), 4,4'-thiobis(6-tert-butyl-3-methylphenol), 4,4'-thiobis(6-tert-butyl-2-methylphenol), 4,4'-thiobis-(3,6-di-sec-amylphenol), 4,4'-bis-(2,6-dimethyl-4-hydroxyphenyl)disulfide, and combinations thereof, may also be used.

It is also contemplated that alkylidenebisphenols, for example 2, 2'-methylenebis(6-tert-butyl-4-methylphenol), 2,2'-methylenebis(6-tert-butyl-4-ethylphenol), 2,2'-methylenebis[4-methyl-6-(α-methylcyclohexyl)phenol], 2,2'-methylenebis(4-methyl-6-cyclohexylphenol), 2,2'-methylenebis (6-nonyl-4-methylphenol), 2,2'-methylenebis(4,6-di-tert-butylphenol), 2,2'-ethylidenebis(4,6-di-tert-butylphenol), 2,2'-ethylidenebis(6-tert-butyl-4-isobutylphenol), 2,2'-methylenebis[6-(α-methylbenzyl)-4-nonylphenol], 2,2'-methylenebis[6-(α,α-dimethylbenzyl)-4-nonylphenol], 4,4'-methylenebis(2,6-di-tert-butylphenol), 4,4'-methylenebis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl) butane, 1,1-bis(5-tert-butyl-4-hydroxy-2-methyl-phenyl)-3-n-dodecylmercapto butane, ethylene glycol bis[3,3-bis(3'-tert-butyl-4'-hydroxyphenyl) butyrate], bis(3-tert-butyl-4-hydroxy-5-methyl-phenyl)dicyclopentadiene, bis[2-(3'-tert-butyl-2'-hydroxy-5'-methylbenzyl)-6-tert-butyl-4-methylphenyl]terephthalate, 1,1-bis-(3,5-dimethyl-2-hydroxyphenyl)butane, 2,2-bis-(3,5-di-tert-butyl-4-hydroxyphenyl)propane, 2,2-bis-(5-tert-butyl-4-hydroxy-2-methylphenyl)-4-n-dodecylmercaptobutane, 1,1,5,5-tetra-(5-tert-butyl-4-hydroxy-2-methyl phenyl)pentane, and combinations thereof may be utilized as antioxidants.

O-, N- and S-benzyl compounds, for example 3, 5,3',5'-tetra-tert-butyl-4,4'-dihydroxydibenzyl ether, octadecyl-4-hydroxy-3,5-dimethylbenzylmercaptoacetate, tris-(3,5-di-tert-butyl-4-hydroxybenzyl)amine, bis(4-tert-butyl-3-hydroxy-2,6-dimethylbenzyl)dithiol terephthalate, bis(3,5-di-tert-butyl-4-hydroxybenzyl)sulfide, isooctyl-3,5di-tert-butyl-4-hydroxy benzylmercaptoacetate, and combinations thereof, may also be utilized.

Hydroxybenzylated malonates, for example dioctadecyl-2,2-bis-(3,5-di-tert-butyl-2-hydroxybenzyl)-malonate, di-octadecyl-2-(3-tert-butyl-4-hydroxy-5-methylbenzyl)-malonate, di-dodecylmercaptoethyl-2,2-bis-(3,5-di-tert-butyl-4-hydroxybenzyl)malonate, bis[4-(1,1,3,3-tetramethylbutyl)phenyl]-2,2-bis(3,5-di-tert-butyl-4-hydroxybenzyl) malonate, and combinations thereof are also suitable for use as antioxidants.

Triazine Compounds, for example 2,4-bis(octylmercapto)-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl)isocyanurate, 1,3,5-tris(4-tert-butyl-3-hydroxy-2,6-dimethylbenzyl 2,4,6-tris(3,5-di-tert-butyl-4-hydroxyphenylethyl)-1,3,5-triazine, 1,3,5-tris(3,5-di-tert-butyl-4-hydroxyphenyl propionyl)-hexahydro-1,3,5-triazine, 1,3,5-tris(3,5-dicyclohexyl-4-hydroxybenzyl) isocyanurate, and combinations thereof, may also be used.

Additional suitable, but non-limiting examples of antioxidants include aromatic hydroxybenzyl compounds, for example 1,3,5-tris-(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris(3,5-di-tert-butyl-4-hydroxybenzyl)phenol, and combinations thereof. Benzylphosphonates, for example dimethyl-2,5-di-tert-butyl-4-hydroxybenzylphosphonate, diethyl-3,5-di-tert-butyl-4-hydroxybenzylphosphonate, dioctadecyl 3,5-di-tert-butyl-4-hydroxybenzylphosphonate, dioctadecyl-5-tert-butyl-4-hydroxy 3-methylbenzylphosphonate, the calcium salt of the monoethyl ester of 3,5-di-tert-butyl-4-hydroxybenzylphosphonic acid, and combinations thereof, may also be utilized. In addition, acylaminophenols, for example 4-hydroxylauranilide, 4-hydroxystearanilide, octyl N-(3,5-di-tert-butyl-4-hydroxyphenyl)carbamate.

Esters of [3-(3,5-di-tert-butyl-4-hydroxyphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl) isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane, and combinations thereof, may also be used. It is further contemplated that esters of β-(5-tert-butyl-4-hydroxy-3-methylphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl) isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane, and combinations thereof, may be used. Esters of 13-(3,5-dicyclohexyl-4-hydroxyphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl) isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane, and combinations thereof, may also be used. Moreover, esters of 3,5-di-tert-butyl-4-hydroxyphenyl acetic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl) isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane, and combinations thereof, may be utilized.

Additional non-limiting examples of suitable antioxidants include those that include nitrogen, such as amides of β-(3,5-di-tert-butyl-4-hydroxyphenyl)propionic acid e.g. N,N'-bis(3,5-di-tert-butyl-4-hydroxyphenylpropionyl)hexamethylenediamine, N,N'-bis(3,5-di-tert-butyl-4-hydroxyphenylpropionyl)trimethylenediamine, N,N'-bis(3,5-di-tert-butyl-4-hydroxyphenylpropionyl)hydrazine. Other suitable non-limiting examples of antioxidant include aminic antioxidants such as N,N'-diisopropyl-p-phenylenediamine, N,N'-di-sec-butyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N-bis(2-naphthyl)-p-phenylenediamine, N-isopropyl-N'-phenyl-p-phenylenediamine, N-(1,3-dimethyl-butyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfamoyl)diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-phenyl-2-naphthylamine, octylated diphenylamine, for example p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, bis(4-methoxyphenyl)amine, 2,6-di-tert-butyl-4-dimethylamino methylphenol, 2,4'-diaminodiphenylmethane, 4,4'-diaminodiphenylmethane, N,N,N',N'-tetramethyl-4,4'-diaminodiphenylmethane, 1,2-bis[(2-methyl-phenyl)amino]ethane, 1,2-bis(phenylamino) propane, (o-tolyl)biguanide, bis[4-(1',3'-dimethylbutyl)phenyl]amine, tert-octylated N-phenyl-1-naphthylamine, a mixture of mono- and dialkylated tert-butyl/tert-octyldiphenylamines, a mixture of mono- and dialkylated isopropyl/isohexyldiphenylamines, mixtures of mono- and dialkylated tert-butyldiphenylamines, 2,3-dihydro-3,3-dimethyl-4H-1,4-benzothiazine, phenothiazine, N-allylphenothiazine, N,N,N',N'-tetraphenyl-1,4-diaminobut-2-ene, N,N-bis(2,2,6,6-tetramethylpiperid-4-yl-hexamethylenediamine, bis(2,2,6,6-tetramethyl piperid-4-yl)sebacate, 2,2,6,6-tetramethylpiperidin-4-one and 2,2,6,6-tetramethyl piperidin-4-ol, and combinations thereof.

Even further non-limiting examples of suitable antioxidants includes aliphatic or aromatic phosphites, esters of thiodipropionic acid or of thiodiacetic acid, or salts of dithiocarbamic or dithiophosphoric acid, 2,2,12,12-tetramethyl-5,9-dihydroxy-3,7,1-trithiamidecane and 2,2,15,15-tetramethyl-5,12-dihydroxy-3,7,10,14-tetrathiahexadecane, and combinations thereof. Furthermore, sulfurized fatty esters, sulfurized fats and sulfurized olefins, and combinations thereof, may be used. It is also contemplated that the antioxidant may be as described in U.S. Ser. No. 61/232,060, filed on Aug. 7, 2009, the disclosure of which is expressly incorporated herein by reference in its entirety.

The one or more antioxidants are not particularly limited in amount in the composition but are typically present in an amount of from 0.1 to 2, 0.5 to 2, 1 to 2, or 1.5 to 2, parts by weight per 100 parts by weight of the composition. Alternatively, the one or more antioxidants may be present in amounts of less than 2, less than 1.5, less than 1, or less than 0.5, parts by weight per 100 parts by weight of the composition.

Metal Deactivators:

In various embodiments, one or more metal deactivators can be included in the composition. Suitable, non-limiting examples of the one or more metal deactivators include benzotriazoles and derivatives thereof, for example 4- or 5-alkylbenzotriazoles (e.g. triazole) and derivatives thereof, 4,5,6,7-tetrahydrobenzotriazole and 5,5'-methylenebisbenzotriazole; Mannich bases of benzotriazole or triazole, e.g. 1-[bis(2-ethylhexyl)aminomethyl)triazole and 1-[bis(2-ethylhexyl)aminomethyl)benzotriazole; and alkoxyalkylbenzotriazoles such as 1-(nonyloxymethyl)benzotriazole, 1-(1-butoxyethyl)benzotriazole and 1-(1-cyclohexyloxybutyl) triazole, and combinations thereof.

Additional non-limiting examples of the one or more metal deactivators include 1,2,4-triazoles and derivatives thereof, for example 3-alkyl(or aryl)-1,2,4-triazoles, and Mannich bases of 1,2,4-triazoles, such as 1-[bis(2-ethylhexyl)aminomethyl-1,2,4-triazole; alkoxyalkyl-1,2,4-triazoles such as 1-(1-butoxyethyl)-1,2,4-triazole; and acylated 3-amino-1,2,4-triazoles, imidazole derivatives, for example 4, 4'-methylenebis(2-undecyl-5-methylimidazole) and bis[(N-methyl) imidazol-2-yl]carbinol octyl ether, and combinations thereof.

Further non-limiting examples of the one or more metal deactivators include sulfur-containing heterocyclic compounds, for example 2-mercaptobenzothiazole, 2,5-dimercapto-1,3,4-thiadiazole and derivatives thereof; and 3,5-bis[di(2-ethylhexyl)aminomethyl]-1,3,4-thiadiazolin-2-one, and combinations thereof. Even further non-limiting examples of the one or more metal deactivators include amino compounds, for example salicylidenepropylenediamine, salicylaminoguanidine and salts thereof, and combinations thereof. It is also contemplated that the metal deactivator may be as described in U.S. Ser. No. 61/232,060, filed on Aug. 7, 2009, the disclosure of which is expressly incorporated herein by reference in its entirety.

The one or more metal deactivators are not particularly limited in amount in the composition but are typically present in an amount of from 0.01 to 0.1, from 0.05 to 0.01, or from 0.07 to 0.1, parts by weight per 100 parts by weight of the composition. Alternatively, the one or more metal deactivators may be present in amounts of less than 0.1, of less than 0.7, or less than 0.5, parts by weight per 100 parts by weight of the composition.

Rust Inhibitors and Friction Modifiers:

In various embodiments, one or more additional rust inhibitors (in addition to the one or more alkylethercarboxylic acid corrosion inhibitor(s) described above) and/or one or more friction modifiers can be included in the composition. Suitable, non-limiting examples of the one or more additional rust inhibitors and/or one or more friction modifiers include organic acids, their esters, metal salts, amine salts and anhydrides, for example alkyl- and alkenylsuccinic acids and their partial esters with alcohols, diols or hydroxycarboxylic acids, partial amides of alkyl- and alkenylsuccinic acids, 4-nonylphenoxyacetic acid, alkoxy- and alkoxyethoxycarboxylic acids such as dodecyloxyacetic acid, dodecyloxy(ethoxy) acetic acid and the amine salts thereof, and also N-oleoylsarcosine, sorbitan monooleate, lead naphthenate, alkenylsuccinic anhydrides, for example dodecenylsuccinic anhydride, 2-carboxymethyl-1-dodecyl-3-methylglycerol and the amine salts thereof, and combinations thereof. Additional suitable, non-limiting examples of the one or more rust inhibitors and/or friction modifiers include nitrogen-containing compounds, for example, primary, secondary or tertiary aliphatic or cycloaliphatic amines and amine salts of organic and inorganic acids, for example oil-soluble alkylammonium carboxylates, and also 1-[N,N-bis(2-hydroxyethyl)amino]-3-(4-nonylphenoxy)propan-2-ol, and combinations thereof. Further suitable, non-limiting examples include heterocyclic compounds, for example: substituted imidazolines and oxazolines, and 2-heptadecenyl-1-(2-hydroxyethyl)imidazoline, phosphorus-containing compounds, for example: Amine salts of phosphoric acid partial esters or phosphonic acid partial esters, and zinc dialkyldithiophosphates, molybdenum-containing compounds, such as molydbenum dithiocarbamate and other sulfur and phosphorus containing derivatives, sulfur-containing compounds, for example: barium dinonylnaphthalenesulfonates, calcium petroleum sulfonates, alkylthio-substituted aliphatic carboxylic acids, esters of aliphatic 2-sulfocarboxylic acids and salts thereof, glycerol derivatives, for example: glycerol monooleate, 1-(alkylphenoxy)-3-(2-hydroxyethyl)glycerols, 1-(alkylphenoxy)-3-(2,3-dihydroxypropyl) glycerols and 2-carboxyalkyl-1,3-dialkylglycerols, and combinations thereof.

The one or more additional rust inhibitors and/or one or more friction modifiers are not particularly limited in amount in the composition but may be present in an amount of from 0.05 to 0.5, 0.01 to 0.2, from 0.05 to 0.2, 0.1 to 0.2, 0.15 to 0.2, or 0.02 to 0.2, parts by weight per 100 parts by weight of the composition. Alternatively, the one or more additional rust inhibitors and/or one or more friction modifiers may be present in amounts of less than 0.5, less than 0.4, less than 0.3, less than 0.2, less than 0.1, less than 0.5, or less than 0.1, parts by weight per 100 parts by weight of the composition.

Viscosity Index Improvers:

In various embodiments, one or more viscosity index improvers can be included in the composition. Suitable, non-limiting examples of the one or more viscosity index improvers include polyacrylates, polymethacrylates, vinylpyrrolidone/methacrylate copolymers, polyvinylpyrrolidones, polybutenes, olefin copolymers, styrene/acrylate copolymers and polyethers, and combinations thereof. It is also contemplated that the viscosity index improvers may be as described in U.S. Ser. No. 61/232,060, filed on Aug. 7, 2009, the disclosure of which is expressly incorporated herein by reference in its entirety. The one or more viscosity index improvers are not particularly limited in amount in the composition but are typically present in an amount of from 1 to 1, from 2 to 8, from 3 to 7, from 4 to 6, or from 4 to 5, parts by weight per 100 parts by weight of the composition. Alternatively, the one or more viscosity index improvers may be present in an amount of less than 10, 9, 8, 7, 6, 5, 4, 3, 2, or 1, part by weight per 100 parts b eight of the composition.

Pour Point Depressants:

In various embodiments, one or more pour point depressants can be included in the composition. Suitable, non-limiting examples of the pour point depressants include polymethacrylate and alkylated naphthalene derivatives, and combinations thereof. It is also contemplated that the pour point depressants may be as described in U.S. Ser. No. 61/232,060, filed on Aug. 7, 2009, the disclosure of which is expressly incorporated herein by reference in its entirety. The one or more pour point depressants are not particularly limited in amount in the composition but are typically present in an amount of from 0.1 to 1, from 0.5 to 1, or from 0.7 to 1, part by weight per 100 parts by weight of the composition. Alternatively, the one or more pour point depressants may be present in amounts of less than 1, less than 0.7, or less than 0.5, parts by weight per 100 parts by weight of the composition.

Dispersants:

In various embodiments, one or more dispersants can be included in the composition. Suitable, non-limiting examples of the one or more dispersants include polybutenylsuccinic amides or -imides, polybutenylphosphonic acid derivatives and basic magnesium, calcium and barium sulfonates and phenolates, succinate esters and alkylphenol amines (Mannich bases), and combinations thereof. It is also contemplated that the dispersants may be as described in U.S. Ser. No. 61/232,060, filed on Aug. 7, 2009, the disclosure of which is expressly incorporated herein by reference in its entirety.

The one or more dispersants are not particularly limited in amount in the composition but are typically present in an amount of from 0.1 to 5, from 0.5 to 4.5, from 1 to 4, from 1.5 to 3.5, from 2 to 3, or from 2.5 to 3, parts by weight per 100 parts by weight of the composition. Alternatively, the one or more dispersants may be present in an amount of less than 5, 4.5, 3.5, 3, 2.5, 2, 1.5, or 1, part by weight per 100 parts by weight of the composition.

Detergents:

In various embodiments, one or more detergents can be included in the composition. Suitable, non-limiting examples of the one or more detergents include overbased or neutral metal sulphonates, phenates and salicylates, and combinations thereof. It is also contemplated that the detergents may be as described in U.S. Ser. No. 61/232,060, filed on Aug. 7, 2009, the disclosure of which is expressly incorporated herein by reference in its entirety.

The one or more detergents are not particularly limited in amount in the composition but are typically present in an amount of from 0.1 to 5, from 0.5 to 4.5, from 1 to 4, from 1.5 to 3.5, from 2 to 3, or from 2.5 to 3, parts by weight per 100 parts by weight of the composition. Alternatively, the one or more detergents may be present in an amount of less than 5, 4.5, 3.5, 3, 2.5, 2, 1.5, or 1, part by weight per 100 parts by weight of the composition.

In various embodiments, the composition is substantially free of water, e.g. includes less than 5, 4, 3, 2, or 1, weight percent of water. Alternatively, the composition may include less than 0.5 or 0.1 weight percent of water or may be free of water.

Additive Concentrate Package:

The instant invention also provides an additive concentrate package which includes one or more metal deactivators, one or more antioxidants, one or more anti-wear additives, one or more alkylethercarboxylic acid corrosion inhibitors of this invention, and one or more ashless antiwear additives including phosphorous of this invention. One or more of the aforementioned compounds may be ash-containing or ash-less as first introduced and described above. In various embodiments, the additive concentrate package may include one or more additional additives as described above. In one embodiment, the additive concentrate package is further defined as a hydraulic additive concentrate package. In another embodiment, the additive concentrate package includes 10-40 weight percent of an antioxidant (e.g. an aminic antioxidant, a phenolic antioxidant, or a combination of both), 0-15 weight percent of a metal deactivator (e.g. a yellow metal corrosion inhibitor), 0-15 weight percent of a corrosion inhibitor (e.g. the corrosion inhibitor of this invention and a ferrous metal corrosion inhibitor), 0-10 weight percent of a friction modifier (e.g. glycerol mono-oleate), 20-35 weight percent of an anti-wear additive, and 0-1 weight percent of an anti-foam additive. Additionally, 0-25 weight percent of a dispersant may also be included. Viscosity modifiers and pour point depressants may also be included but typically are not part of such packages. The additive package may be included in the composition in amounts of from 0.1 to 1, from 0.2 to 0.9, from 0.3 to 0.8, from 0.4 to 0.7, or from 0.5 to 0.6, parts by weight per 100 parts by weight of the composition.

Some of the compounds described above may interact in the lubricant composition, so the components of the lubricant composition in final form may be different from those components that are initially added or combined together. Some products formed thereby, including products formed upon employing the composition of this invention in its intended use, are not easily described or describable. Nevertheless, all such modifications, reaction products, and products formed upon employing the composition of this invention in its intended use, are expressly contemplated and hereby included herein. Various embodiments of this invention include one or more of the modification, reaction products, and products formed from employing the composition, as described above.

Method of Forming the Composition:

This invention also provides a method of forming the composition. The method includes the steps of providing the base oil, providing one or more of the alkylethercarboxylic acid corrosion inhibitor(s), and providing the ashless antiwear additive including phosphorous. The method also includes the step of combining the base oil, the one or more alkylethercarboxylic acid corrosion inhibitor(s), and the ashless antiwear additive to form the composition. The base oil, the one or more alkylethercarboxylic acid corrosion inhibitor(s), and the ashless antiwear additive may be combined in any order and each individually in one or more separate parts.

Method for Reducing Wear of a Metal:

This invention also provides a method for reducing wear of a metal, e.g. a metal article. The method may include any one or more of the aforementioned method steps. The method of reducing wear of the metal includes the step of providing the metal and the step of applying the lubricant composition to the metal.

The step of providing the metal can occur before, after, or simultaneously with, the optional steps of providing the base oil, providing one or more of the alkylethercarboxylic acid corrosion inhibitor(s), providing the ashless antiwear additive, and/or combining the base oil, the one or more alkylethercarboxylic acid corrosion inhibitor(s), and the ashless antiwear additive to form a lubricant composition.

Antiwear Properties:

The composition of this invention has improved four-ball antiwear properties. Relative to the method of this invention, the method reduces wear of a metal, as described above, wherein the metal also has improved four-ball antiwear properties. The four-ball antiwear properties are reported as an average diameter of wear scars pursuant to ASTM D4172. The average diameter of the wear scars produced after applying the lubricant composition to the metal are at least 5% smaller than the average diameter of the wear scars produced after applying a standard to the metal. The standard includes the base oil and the antiwear additive and is free of the one or more alkylethercarboxylic acid corrosion inhibitor(s). The standard may be further described as a comparative composition that serves as a baseline against which to assess the efficacy of the composition of this invention. In various embodiments, the average diameter of the wear scars produced after applying the lubricant composition to the metal are at least 10%, 15%, 20%, 25%, 30%, 35%, 40%, 45%, 50%, 55%, 60%, etc., smaller than the average diameter of the wear scars produced after applying a standard to the metal. The metal is not particularly limited and may include steel, iron, aluminum, and the like.

In additional embodiments, the composition has improved FZG Scuffing Load Capacity measured pursuant to ASTM D5182. This scuffing test is used to determine an extent to which lubricant compositions prevent or minimized scuffing on tooth faces of gears at a lubrication gap. Scuffing typically occurs at points where gears are in mesh, e.g. at contact points where surfaces weld together briefly and are torn apart as the gears revolve, which leads to partial destruction of the surfaces. Typically, a defined load is applied to a pair of gears and the gears are engaged. After a certain period of time, the load is increased. After each engagement, and before the load is increased, the gears are visually inspected and wear is measured. If wear exceeds a certain limit, the test is terminated and the last load is documented along with an amount of material (mg) of the gears that is lost. In various embodiments, the composition has an FZG Scuffing Load Capacity of at least 10, 11, 12, or even higher, measured pursuant to ASTM D5182. Just as above, the FZG Scuffing Load Capacity may be increased 5%, 10%, 15%, etc. as compared to a standard. The standard for this evaluation may also include the base oil and the antiwear additive and be free of the one or more alkylethercarboxylic acid corrosion inhibitor(s). The standard may be further described as a comparative composition that serves as a baseline against which to assess the efficacy of the composition of this invention.

It is contemplated that the one or more alkylethercarboxylic acid corrosion inhibitor(s) may synergistically interact with the ashless antiwear additive to improve four-ball antiwear properties and/or scuffing load capacity. The terminology "synergistically interact" is not particularly limiting and typically describes the unexpected positive interaction of the one or more alkylethercarboxylic acid corrosion inhibitor(s) and the ashless antiwear additive. Said differently, the one or more alkylethercarboxylic acid corrosion inhibitor(s) may positively interact with the ashless antiwear additive such that unexpected improvements in corrosion inhibition and/or wearing may be observed.

In one additional embodiment, the lubricant composition has improved four-ball antiwear properties and scuffing load capacity and includes the base oil, the one or more alkylethercarboxylic acid corrosion inhibitor(s), and the ashless antiwear additive including phosphorous. In this embodiment, the one or more alkylethercarboxylic acid corrosion inhibitor(s) synergistically interacts with the ashless antiwear additive to improve four-ball antiwear properties and scuffing load capacity. The average diameter of the wear scars resulting from the synergistic interaction in the lubricant composition of this embodiment are at least 5% smaller than the average diameter of the wear scars resulting from a standard that includes the base oil and the ashless antiwear additive and that is free of the one or more alkylethercarboxylic acid corrosion inhibitor(s), and wherein the scuffing load capacity resulting from the synergistic interaction in the lubricant composition is at least a failure load 12.

In another additional embodiment the lubricant composition has improved four-ball antiwear properties and scuffing load capacity and consists essentially of the base oil, the one or more alkylethercarboxylic acid corrosion inhibitor(s), and the ashless antiwear additive. The ashless antiwear additive may be selected from the group of phosphorothionates, phosphorodithioates, phosphates, and phosphites. In an additional embodiment, "n" of the one or more alkylethercarboxylic acid corrosion inhibitor(s) is 3 and the ashless antiwear additive is selected from the group of phosphorothionates, phosphorodithioates, phosphates, and phosphites.

Furthermore, the composition may be applied to a steel article to reduce corrosion of that article as evaluated according to ASTM D 665 B to determine whether any corrosion occurs and whether the article passes the test. The composition may also pass ASTM D 1401 with an emulsion time of less than 30, 25, 20, 15, 10, 9, 8, 7, 6, 5, or 4, minutes. Moreover, the composition may also have a calcium compatibility measured according to a filtration index of 1.5, 1.45, 1.4, 1.35, 1.3, 1.25, 1.2, 1.15, 1.1, 1.05, or 1, as determined using the modified Lubrication Engineering method described in U.S. application Ser. No. 12/852,147, incorporated herein by reference.

EXAMPLES

Various lubricant compositions are formed according to this invention. A series of comparative compositions are also formed but do not represent this invention.

Comparative Compositions 1A-10A do not include any corrosion inhibitor, include about 0.04 wt % of an antiwear additive (as set forth below), and a balance of Mobil Jurong VG46.

Comparative Compositions 1B-10B include about 0.03 wt % of a nonyl phenoxyacetic acid corrosion inhibitor commercially available from BASF Corporation under the trade name of Irgacor® NPA and which is not representative of this invention, about 0.04 wt % of an antiwear additive (as set forth below), and a balance of Mobil Jurong VG46.

Comparative Composition 1C includes about 0.03 wt % of an inventive alkylethercarboxylic acid corrosion inhibitor, about 0.04 wt % of zinc dithiophosphate which is not representative of this invention because it is ashed, and a balance of Mobil Jurong VG46.

Inventive Compositions 2C-10C include about 0.03 wt % of the inventive alkylethercarboxylic acid corrosion inhibitor of this invention, about 0.04 wt % of an inventive antiwear additive (as set forth in Table 1 below), and a balance of Mobil Jurong VG46.

The inventive alkylethercarboxylic acid corrosion inhibitor used to form Comparative Composition 1C and Inventive Compositions 2C-10C has a chemical structure as shown below:

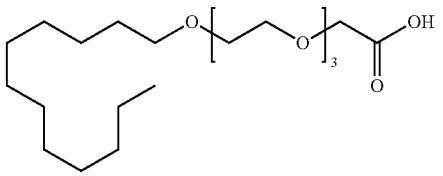

After formation, the Compositions and Comparative Compositions are applied to a metal (i.e., metal bearings) and evaluated to determine four-ball antiwear properties pursuant to ASTM D4172. Each of the four-ball antiwear properties (reported as Average Diameter of Wear Scars (mm)) measured for the Compositions and Comparative Compositions are set forth in Table 1 below and illustrated in FIG. 1. In addition, a percent difference in average diameter of wear scars (mm) between (Comparative Compositions A and Inventive Compositions C), and between (Comparative Compositions B and Inventive Compositions C), is also calculated and set forth in Table 1 below.

TABLE 1

| Antiwear Additive (0.04 Wt %) | No Corrosion Inhibitor 0.0 Wt % | Comparative Corrosion Inhibitor 0.03 Wt % | Inventive Corrosion Inhibitor 0.03 Wt % | Percent Difference in Wear Scar (mm) Between (Comp. Compositions A and Invent. Compositions C)/ (Comp. Compositions B and Invent. Compositions C) |
|---|---|---|---|---|
| Zinc Dithiophosphate (Ashed-Comparative) | 0.6 mm (Comp 1A) | 0.85 mm (Comp 1B) | 0.95 mm (Comp 1C) | Not Applicable |
| Triphenyl Phosphorothionate (Ashless-Inventive) | 1.5 mm (Comp 2A) | 1.23 mm (Comp 2B) | 1.1 mm (Invent 2C) | −27%/−11% |
| Butylated Triphenyl Phosphorothionate (Ashless-Inventive) | 1.6 mm (Comp 3A) | 1.47 mm (Comp 3B) | 0.6 mm (Invent 3C) | −63%/−59% |
| Nonyl Triphenyl Phosphorothionate (Ashless-Inventive) | 1.77 mm (Comp 4A) | 1.3 mm (Comp 4B) | 0.61 mm (Invent 4C) | −66%/−53% |
| Decyl Diphenylphosphite (Ashless-Inventive) | 1.63 mm (Comp 5A) | 1.2 mm (Comp 5B) | 1.1 mm (Invent 5C) | −33%/−8% |
| Amine Phosphate + Ditridecyl Amine (Ashless-Inventive) | 1.6 mm (Comp 6A) | 0.53 mm (Comp 6B) | 0.58 mm (Invent 6C) | −64%/+9%* |
| Neutral Dialkyl Dithiophosphate (Ashless-Inventive) | 0.8 mm (Comp 7A) | 1.6 mm (Comp 7B) | 0.79 mm (Invent 7C) | −1%/−51% |
| Isopropyl Phosphorodithioate + Ditridecyl Amine (Ashless-Inventive) | 0.5 mm (Comp 8A) | 0.95 mm (Comp 8B) | 0.45 mm (Invent 8C) | −10%/−53% |
| Acidic Dialkyl Dithiophosphate (Ashless-Inventive) | 0.56 mm (Comp 9A) | 0.55 mm (Comp 9B) | 0.45 mm (Invent 9C) | −20%/−18% |
| Acidic Dialkyl Dithiophosphate + Ditridecyl Amine (Ashless-Inventive) | 0.54 mm (Comp 10A) | 0.5 mm (Comp 10B) | 0.44 mm (Invent 10C) | −19%/−12% |

*Inventive Composition 6C has larger average diameter wear scars than Comparative Composition 6B The data set forth above in Table 1 shows that Inventive Compositions 2C to 10C consistently outperform Comparative Compositions 1A-10A and are associated with wear scars that have an average diameter that is about 34% smaller. In addition, the data shows that Inventive Compositions 2C to 10C outperform Comparative Compositions 1B to 5B and 7C to 10C and are associated with wear scars that have an average diameter that is about 33% smaller. This performance is both unexpected and surprising because addition of a corrosion inhibitor to a composition that includes an antiwear addition would typically be expected to cause a reduction in antiwear performance. As shown by the data in Table 1, not only is the antiwear performance not reduced but it is actually increased.

Additional lubricant compositions (Comparative Compositions 11(A-C) to 17(A-C)) are also formed as additional comparative Compositions and do not represent this invention. Comparative Compositions 11A-17A include about 0.03 wt % of Amine O corrosion inhibitor (i.e., a substituted imidazoline) which is not representative of this invention, about 0.04 wt % of an antiwear additive (as set forth below), and a balance of Mobil Jurong VG46.

Comparative Compositions 11B-17B include about 0.03 wt % of Irgacor® L12 corrosion inhibitor (i.e., a alkenylsuccinic acid half ester) which is not representative of this invention, about 0.04 wt % of an antiwear additive (as set forth below), and a balance of Mobil Jurong VG46.

Comparative Compositions 11C-17C include about 0.03 wt % of Irgacor® L17 corrosion inhibitor which is not representative of this invention, about 0.04 wt % of an antiwear additive (as set forth below), and a balance of Mobil Jurong VG46.

After formation, the Comparative Compositions are applied to a metal (i.e., metal bearings) and evaluated to determine four-ball antiwear properties pursuant to ASTM D4172, as described above. These results are set forth in Table 2 below with comparisons to the Inventive Compositions set forth above.

TABLE 2

| Antiwear Additive (0.04 Wt %) | Inventive Corrosion Inhibitor 0.03 Wt % | Comp. Corrosion Inhibitor 2 0.03 Wt % | Comp. Corrosion Inhibitor 3 0.03 Wt % | Comp. Corrosion Inhibitor 4 0.03 Wt % | Percent Difference in Wear Scar (mm) Between (Invent C) and (Comp A)/(Comp B)/(Comp C) |
|---|---|---|---|---|---|
| Triphenyl Phosphorothionate (Ashless-Inventive) | 1.1 mm (Invent 2C) | 1.73 mm (Comp 11A) | 1.67 mm (Comp 11B) | 1.17 mm (Comp 11C) | −36%/−34%/−6% |
| Butylated Triphenyl Phosphorothionate (Ashless-Inventive) | 0.6 mm (Invent 3C) | 0.84 mm (Comp 12A) | 1.67 mm (Comp 12B) | 0.84 mm (Comp 12C) | −29%/−64%/−29% |
| Nonyl Triphenyl Phosphorothionate (Ashless-Inventive) | 0.61 mm (Invent 4C) | 1.67 mm (Comp 13A) | 1.27 mm (Comp 13B) | 1.03 mm (Comp 13C) | −63%/−52%/−41% |
| Amine Phosphate + Ditridecyl Amine (Ashless-Inventive) | 0.58 mm (Invent 6C) | 1.83 mm (Comp 14A) | 1.53 mm (Comp 14B) | 0.7 mm (Comp 14C) | −68%/−62%/−17% |
| Isopropyl Phosphorodithioate + Ditridecyl Amine (Ashless-Inventive) | 0.45 mm (Invent. 8C) | 0.4 mm (Comp 15A) | 0.61 mm (Comp 15B) | 0.53 mm (Comp 15C) | +13%*/−26%/−15% |
| Acidic Dialkyl Dithiophosphate (Ashless-Inventive) | 0.45 mm (Invent. 9C) | 0.54 mm (Comp 16A) | 0.78 mm (Comp 16B) | 1.37 mm (Comp 16C) | −17%/−42%/−67% |
| Acidic Dialkyl Dithiophosphate + Ditridecyl Amine (Ashless-Inventive) | 0.44 mm (Invent. 10C) | 0.42 mm (Comp 17A) | 0.56 mm (Comp 17B) | 0.69 mm (Comp 17C) | +5%**/−21%/−36% |

*Inventive Composition 8C has larger average diameter wear scars than Comparative Composition 15A

Inventive Composition 10C has larger average diameter wear scars than Comparative Composition 17A Additional Examples (Examples A1/5-D1/5 and E) are also formed and evaluated to focus on the effect of the inventive alkylethercarboxylic acid corrosion inhibitor. All of these Examples include identical amounts (i.e., treat rates) of a base oil such that the identity and amounts of the base oil is a constant. The only difference between Examples is that Examples A1, B1, C1, and D1 include varying weight percentages of the inventive alkylethercarboxylic acid corrosion inhibitor described above. Examples A2, B2, C2, and D2 include varying amounts of the comparative nonyl phenoxyacetic acid corrosion inhibitor (Comp. Corr. Inhib. 1), also described above, and serve as comparative examples. Examples A3, B3, C3, and D3 include varying amounts of the comparative Amine O (Comp. Corr. Inhib. 2), also described above, and also serve as comparative examples. Examples A4, B4, C4, and D4 include varying amounts of the comparative Irgacor® L12 (Comp. Corr. Inhib. 3), also described above, and further serve as comparative examples. Examples A5, B5, C5, and D5 include varying amounts of the comparative Irgacor® L17 (Comp. Corr. Inhib. 4), also described above, and serve as even further comparative examples. Example E includes no corrosion inhibitor whatsoever and also serves as a comparative example. These Examples are evaluated to determine four-ball antiwear properties pursuant to ASTM D4172 as a function of treat rate. The results of these evaluations are set forth in Tables 3A and B below and in FIG. 2**.

TABLE 3A

| | Invent. Corr. Inhib. (wt %) | Comp. Corr. Inhib. 1 (wt %) | Comp. Corr. Inhib. 2 (wt %) | Comp. Corr. Inhib. 3 (wt %) | Comp. Corr. Inhib. 4 (wt %) | Avg. Diam. Wear Scar (mm) | Percent Difference in Wear Scar (mm) Between Invent. Corr. Inhib. (A1-D1) and Comp. Corr. Inhib. (1, 2, 3, 4) and E |
|---|---|---|---|---|---|---|---|
| Example A1 | 0.03 | — | — | — | — | 0.68 | — |
| Example A2 | — | 0.03 | — | — | — | 0.75 | −9% |
| Example A3 | — | — | 0.03 | — | — | 0.73 | −7% |
| Example A4 | — | — | — | 0.03 | — | 1.4 | −51% |
| Example A5 | — | — | — | — | 0.03 | 0.6 | +13%* |
| Example B1 | 0.07 | — | — | — | — | 0.60 | — |
| Example B2 | — | 0.07 | — | — | — | 0.78 | −23% |
| Example B3 | — | — | 0.07 | — | — | 1.7 | −65% |
| Example B4 | — | — | — | 0.07 | — | 1.17 | −49% |
| Example B5 | — | — | — | — | 0.07 | 0.69 | −13% |
| Example C1 | 0.15 | — | — | — | — | 0.48 | — |
| Example C2 | — | 0.15 | — | — | — | 1.13 | −58% |
| Example C3 | — | — | 0.15 | — | — | 0.64 | −25% |
| Example C4 | — | — | — | 0.15 | — | 0.65 | −26% |
| Example C5 | — | — | — | — | 0.15 | 0.66 | −27% |
| Example D1 | 0.5 | — | — | — | — | 0.46 | — |
| Example D2 | — | 0.5 | — | — | — | 0.76 | −39% |
| Example D3 | — | — | 0.5 | — | — | 1.8 | −74% |
| Example D4 | — | — | — | 0.5 | — | 0.62 | −26% |
| Example D5 | — | — | — | — | 0.5 | 0.65 | −29% |
| Example E | — | — | — | — | — | 0.81 | −16% (Inventive A1 to E) |

TABLE 3A-continued

| Invent. Corr. Inhib. (wt %) | Comp. Corr. Inhib. 1 (wt %) | Comp. Corr. Inhib. 2 (wt %) | Comp. Corr. Inhib. 3 (wt %) | Comp. Corr. Inhib. 4 (wt %) | Avg. Diam. Wear Scar (mm) | Percent Difference in Wear Scar (mm) Between Invent. Corr. Inhib. (A1-D1) and Comp. Corr. Inhib. (1, 2, 3, 4) and E |
|---|---|---|---|---|---|---|
| | | | | | | −26% (Inventive B1 to E)<br>−41% (Inventive C1 to E)<br>−43% (Inventive D1 to E) |

*Example A1 has larger average diameter wear scars than Example A5

The data set forth in Table 3A is rearranged but identically set forth in Table 3B below such that the trends in data are more easily visualized. Table 3B includes wear scar data in mm arranged as a function of treat rate and corrosion inhibitor.

TABLE 3B

| Treat Rate of Corrosion Inhibitors | 0 wt % | 0.03 wt % | 0.07 wt % | 0.15 wt % | 0.5 wt % |
|---|---|---|---|---|---|
| Invent. Corr. Inhib. | 0.81 mm (E) | 0.68 mm (A1) | 0.6 mm (B1) | 0.48 mm (C1) | 0.46 mm (D1) |
| Comp. Corr. Inhib. 1 | 0.81 mm (E) | 0.75 mm (A2) | 0.78 mm (B2) | 1.13 mm (C2) | 0.76 mm (D2) |
| Comp. Corr. Inhib. 2 | 0.81 mm (E) | 0.73 mm (A3) | 1.7 mm (B3) | 0.64 mm (C3) | 1.8 mm (D3) |
| Comp. Corr. Inhib. 3 | 0.81 mm (E) | 1.4 mm (A4) | 1.17 mm (B4) | 0.65 mm (C3) | 0.62 mm (D4) |
| Comp. Corr. Inhib. 4 | 0.81 mm (E) | 0.6 mm (A5) | 0.69 mm (B5) | 0.66 mm (C4) | 0.65 mm (D5) |

Figure 2:
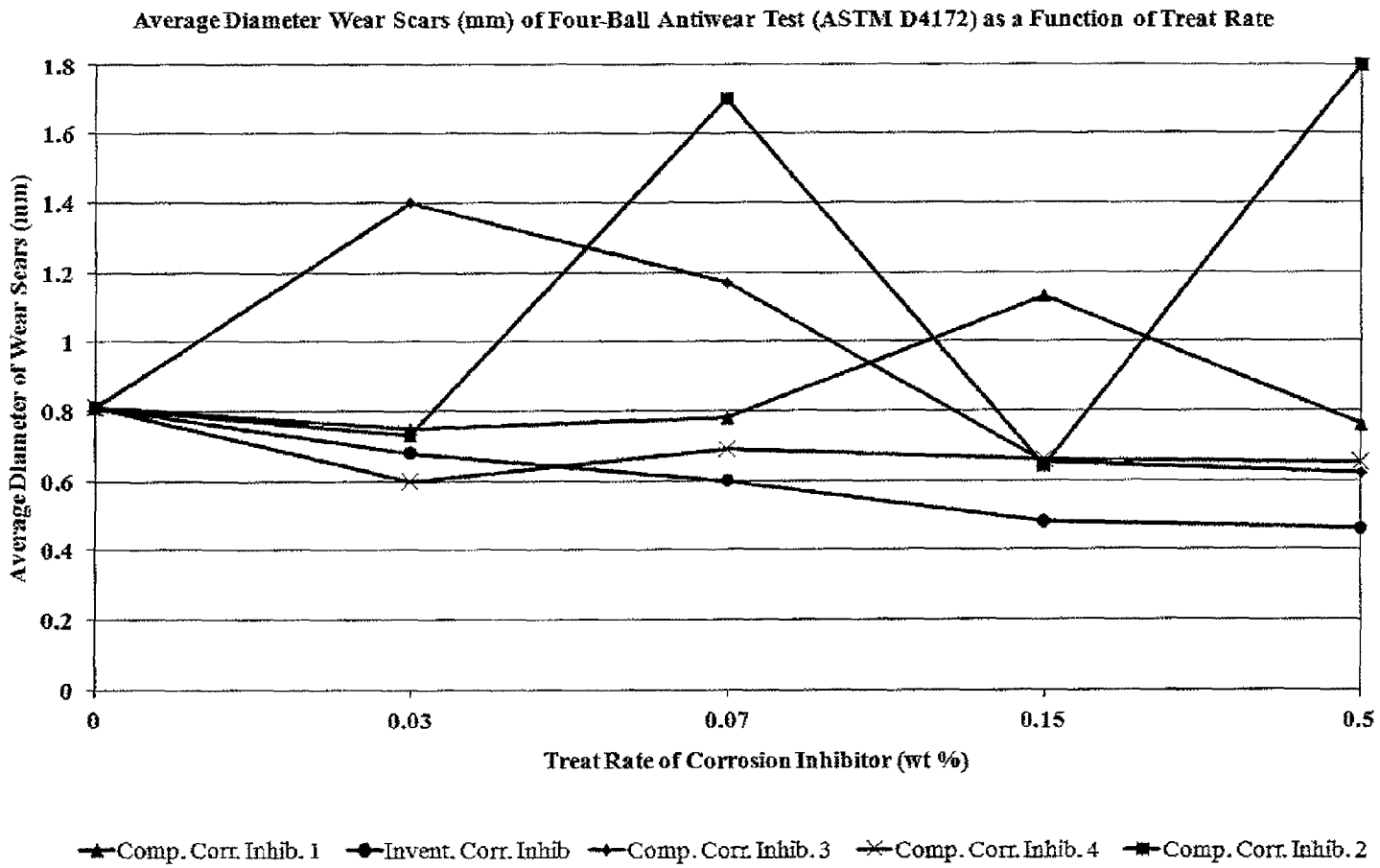
FIG. 2 is a line graph that shows the average wear scars (mm) measured in a Four-Ball Antiwear Test (ASTM D4172) as a function of the treat rate of various comparative corrosion inhibitors and an inventive corrosion inhibitor.

The data set forth in Tables 3A and 3B and FIG. 2 show that the Examples A1, B1, C1, and D1, each of which include the inventive alkylethercarboxylic acid corrosion inhibitor, clearly outperform Examples A(2-5) to D(2-5) and E, except that Example A1 has larger average diameter wear scars than Example A5. This overall performance is both unexpected and surprising because the alkylethercarboxylic acid corrosion inhibitor consistently reduces wear wherein the comparative nonyl phenoxyacetic acid corrosion inhibitor actually increases wear in many Examples and only minimally decreases wear in others.

An additional Inventive Composition (Inventive Composition 11) and two additional Comparative Compositions (Comparative Compositions 18 and 19) are also formed. Inventive Composition 11 and Comparative Compositions 18 and 19 include identical amounts of a base oil, antioxidants, metal deactivators, friction modifiers, and anti-foam additives such that the identities and amounts of each of these components are constants. The only difference between Compositions is that Inventive Composition 11 includes 300 ppm of the inventive alkylethercarboxylic acid corrosion inhibitor described above, Comparative Composition 18 includes 300 ppm of the comparative nonyl phenoxyacetic acid corrosion inhibitor, also described above, and Comparative Composition 19 includes no corrosion inhibitor whatsoever. Each of these Compositions is evaluated to determine FZG Scuffing Load Capacity of Oils pursuant to ASTM D5182. The results of these evaluations are set forth immediately below in Table 4.

TABLE 4

| | Inventive Example 11 | Comparative Composition 18 | Comparative Composition 19 |
|---|---|---|---|
| Failure Load Stage | 12 | 9 | 11 |
| Total Weight Loss (mg) | 1,143 mg | 293 mg | 1,143 mg |

The data set forth in Table 4 indicates that Inventive Composition 11 exhibits a higher FZG Scuffing Load Capacity measured pursuant to ASTM D5182 than Comparative Composition 18. The Inventive Composition can withstand a load of stage 12 before excessive wear is observed while the Comparative Composition can only withstand a load of stage 9 (i.e., a lesser load). This comparison of data shows that this invention provides special and unexpected results associated with unexpectedly high load stage.

Moreover, Comparative Composition 19 exhibits almost identical FZG properties to Inventive Example 11. Since Comparative Composition 18 includes a corrosion inhibitor and Comparative 19 does not, the data associated with Comparative Composition 19 is indicative of the typical and expected result of combining antiwear additives and corrosion inhibitors, i.e., that a decrease in antiwear properties will result due to the antagonistic relationship between the antiwear additive and the corrosion inhibitor. The instant invention not only reduces this antagonism but surprisingly reverses this negative interaction and shows synergistic results of increased wear resistance.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and or in combination and provides adequate support for specific embodiments within the scope of the appended claims.

It is also to be understood that any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

It is contemplated that the weight percent of the one or more of the compounds and/or components of the composition as described above may vary within the values and/or ranges described above and may be further defined as any value or range of values, both whole and fractional, within those ranges and values described above and/or any one or more of the aforementioned compounds and/or components may be present in amounts that vary from the values and/or range of values above by ±5%, ±10%, ±15%, ±20%, ±25%, ±30%, etc, so long as these amounts remain within the scope of the invention.

The subject matter of all combinations of independent and dependent claims, both singly and multiply dependent, is herein expressly contemplated but is not described in detail for the sake of brevity. The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A lubricant composition free of water, having improved four-ball antiwear properties, and comprising:

a base oil present in an amount of greater than 85 parts by weight per 100 parts by weight of said lubricant composition;

one or more alkylethercarboxylic acid corrosion inhibitor(s) having the formula;

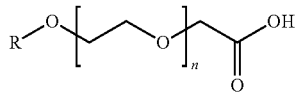

wherein R is a straight or branched chain $C_6$-$C_{18}$ alkyl group and n is a number of from about 2 to about 3 ; and an ashless antiwear additive comprising phosphorous, wherein the four-ball antiwear properties are reported as an average diameter of wear scars pursuant to ASTM D417, wherein the average diameter of the wear scars are at least 5% smaller than the average diameter of the wear scars resulting from a standard that comprises said base oil and said ashless antiwear additive and that is free of said one or more alkylethercarboxylic acid corrosion inhibitor(s), wherein said lubricant composition comprises from 0.01 to less than 0.1 weight percent of said one or more alkylethercarboxylic acid corrosion inhibitor(s); and wherein said lubricant composition further comprises an antioxidant.

2. A lubricant composition as set forth in claim 1 wherein said corrosion inhibitor is present in an amount of from 0.03 to less than 0.1 weight percent based on a total weight percent of said lubricant composition.

3. A lubricant composition as set forth in claim 2 wherein said antiwear additive is present in an amount of from 0.01 to 0.05 weight percent based on a total weight percent of said lubricant composition.

4. A lubricant composition as set forth in claim 3 wherein said base oil comprises one or more customary additives and is present in an amount of at least 99.9 weight percent based on a total weight of said lubricant composition.

5. A lubricant composition as set forth in claim 4 wherein R comprises a $C_{12}$ alkyl group and n is about 3.

6. A lubricant composition as set forth in claim 5 wherein the average diameter of the wear scars resulting from said lubricant composition are at least 10% smaller than the average diameter of the wear scars resulting from the standard.

7. A lubricant composition as set forth in claim 5 wherein the average diameter of the wear scars resulting from said lubricant composition are at least 20% smaller than the average diameter of the wear scars resulting from the standard.

8. A lubricant composition as set forth in claim 5 wherein the average diameter of the wear scars resulting from said lubricant composition are at least 50% smaller than the average diameter of the wear scars resulting from the standard.

9. A lubricant composition as set forth in claim 1 wherein R comprises a $C_{12}$ alkyl group and n is about 3.

10. A lubricant composition as set forth in claim 1 having a FZG Scuffing Load Capacity of at least 12 as measured pursuant to ASTM D5182.

11. A lubricant composition as set forth in claim 1 wherein said corrosion inhibitor is present in an amount of from 0.01 to 0.05 weight percent based on a total weight percent of said lubricant composition, wherein said antiwear additive is present in an amount of from 0.01 to 0.05 weight percent based on a total weight percent of said lubricant composition, wherein said base oil comprises one or more customary additives and is present in an amount of at least 99.9 weight percent based on a total weight of said lubricant composition, and wherein the average diameter of the wear scars resulting from said lubricant composition are at least 10% smaller than the average diameter of the wear scars resulting from the standard, wherein R comprises a $C_{12}$ alkyl group and n is about 3.

12. A method of forming the lubricant composition as set forth in claim 1 comprising the steps of combining the base oil, the one or more alkylethercarboxylic acid corrosion inhibitor(s), the ashless antiwear additive, and the antioxidant.

13. A method of reducing wear of a metal using a lubricant composition free of water and comprising a base oil present in an amount of greater than 85 parts by weight per 100 parts by weight of said lubricant composition, one or more alkylethercarboxylic acid corrosion inhibitor(s) having the formula:

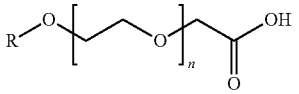

wherein R is a straight or branched chain $C_6$-$C_{18}$ alkyl group and n is a number of from about 2 to about 3, and an ashless antiwear additive comprising phosphorous, said method comprising the steps of:

A. providing the metal; and

B. applying the lubricant composition to the metal;

wherein the metal has four-ball antiwear properties reported as an average diameter of wear scars pursuant to ASTM D4172, wherein the average diameter of the wear scars produced after applying the lubricant composition to the metal are at least 5% smaller than the average diameter of the wear scars produced after applying a standard to the metal, wherein the standard comprises the base oil and the antiwear additive and is free of the one or more alkylethercarboxylic acid corrosion inhibitor(s), wherein the lubricant composition comprises from 0.01 to less than 0.1 weight percent of the one or more alkylethercarboxylic acid corrosion inhibitor(s); and wherein the lubricant composition further comprises an antioxidant.

14. A method as set forth in claim 13 wherein the corrosion inhibitor is present in an amount of from 0.03 to less than 0.1 weight percent based on a total weight percent of the lubricant composition.

15. A method as set forth in claim 14 wherein the antiwear additive is present in an amount of from 0.01 to 0.05 weight percent based on a total weight percent of the lubricant composition.

16. A method as set forth in claim 15 wherein the base oil comprises one or more customary additives and is present in an amount of at least 99.9 weight percent based on a total weight of the lubricant composition.

17. A method as set forth in claim 16 wherein R comprises a $C_{12}$ alkyl group and n is about 3.

18. A method as set forth in claim 17 wherein the average diameter of the wear scars resulting from applying the lubricant composition are at least 10% smaller than the average diameter of the wear scars resulting from applying the standard.

19. A method as set forth in claim 17 wherein the average diameter of the wear scars resulting from applying the lubricant composition are at least 20% smaller than the average diameter of the wear scars resulting from applying the standard.

20. A method as set forth in claim 17 wherein the average diameter of the wear scars resulting from applying the lubricant composition are at least 50% smaller than the average diameter of the wear scars resulting from applying the standard.

21. A method as set forth in claim 13 wherein R comprises a $C_{12}$ alkyl group and n is about 3.

22. A method as set forth in claim 13 wherein the lubricant composition has a FZG Scuffing Load Capacity of at least 12 as measured pursuant to ASTM D5182.

23. A method as set forth in claim 13 wherein the corrosion inhibitor is present in the lubricant composition in an amount of from 0.03 to 0.05 weight percent based on a total weight percent of the lubricant composition, wherein the antiwear additive is present in the lubricant composition in an amount of from 0.01 to 0.05 weight percent based on a total weight percent of the lubricant composition, wherein the base oil comprises one or more customary additives and is present in the lubricant composition in an amount of at least 99.9 weight percent based on a total weight of the lubricant composition, wherein the average diameter of the wear scars resulting from applying the lubricant composition are at least 10% smaller than the average diameter of the wear scars resulting from applying the standard, and wherein R comprises a $C_{12}$ alkyl group and n is about 3.

24. A lubricant composition as set forth in claim 1 wherein said one or more alkylethercarboxylic acid corrosion inhibitor(s) are present in an amount of from 0.01 to 0.07 weight percent based on a total weight of said lubricant composition.

25. A method as set forth in claim 13 wherein the one or more alkylethercarboxylic acid corrosion inhibitor(s) are present in an amount of from 0.01 to 0.07 weight percent based on a total weight of the lubricant composition.

26. A lubricant composition as set forth in claim 24 wherein n is 3.

27. A method as set forth in claim 25 wherein n is 3.

* * * * *